US007454287B2

(12) United States Patent
Manor

(10) Patent No.: US 7,454,287 B2
(45) Date of Patent: Nov. 18, 2008

(54) METHOD AND APPARATUS FOR PROVIDING AUTOMATIC LANE CALIBRATION IN A TRAFFIC SENSOR

(75) Inventor: Dan Manor, Ontario (CA)

(73) Assignee: Image Sensing Systems, Inc. MN (US)

( * ) Notice: Subject to any disclaimer, the term of this patent is extended or adjusted under 35 U.S.C. 154(b) by 666 days.

(21) Appl. No.: 11/182,817

(22) Filed: Jul. 18, 2005

(65) Prior Publication Data

US 2007/0016359 A1 Jan. 18, 2007

(51) Int. Cl.
*G06G 7/70* (2006.01)

(52) U.S. Cl. ..... 701/117; 701/300; 382/106

(58) Field of Classification Search ..... 701/117–119, 701/300–302; 382/104, 106; 340/907, 933
See application file for complete search history.

(56) References Cited

U.S. PATENT DOCUMENTS

| | | | |
|---|---|---|---|
| 4,967,201 | A | 10/1990 | Rich, III |
| 4,977,406 | A | 12/1990 | Tsukamoto et al. |
| 5,161,107 | A | 11/1992 | Mayeaux et al. |
| 5,402,346 | A | 3/1995 | Lion et al. |
| 5,423,080 | A | 6/1995 | Perret et al. |
| 5,621,645 | A | 4/1997 | Brady |
| 5,663,720 | A | 9/1997 | Weissman |
| 5,694,134 | A | 12/1997 | Barnes |
| 5,793,491 | A | 8/1998 | Wangler et al. |
| 5,798,983 | A | 8/1998 | Kuhn et al. |
| 5,878,367 | A | 3/1999 | Lee et al. |
| 5,884,212 | A | 3/1999 | Lion |
| 5,920,280 | A | 7/1999 | Okada et al. |
| 5,949,383 | A | 9/1999 | Hayes et al. |
| 6,114,973 | A | 9/2000 | Winner et al. |
| 6,556,916 | B2 * | 4/2003 | Waite et al. ..... 701/117 |
| 6,577,269 | B2 | 6/2003 | Woodington et al. |
| 6,693,557 | B2 | 2/2004 | Arnold et al. |
| 6,750,787 | B2 | 6/2004 | Hutchinson |

OTHER PUBLICATIONS

Berka S., Kent Lall B. and Fellow, ASCR: "New Perspectives for ATMS: Advanced Technologies in Traffic Detection"—Journal of Transportation Engineering, Jan./Feb. 1998.

(Continued)

*Primary Examiner*—Richard M. Camby
(74) *Attorney, Agent, or Firm*—Bereskin & Parr

(57) ABSTRACT

A method of operating a traffic sensor to define ranges of centers of traffic lanes from the traffic sensor is described. The method comprises a) providing a set of lane center variables representing the ranges of the centers of the traffic lanes from the traffic sensor; b) initializing each lane center variable in the set of lane center variables to have an associated starting range value; and then, c) updating the set of lane center variables by, for each vehicle in a plurality of vehicles, i) detecting the vehicle, ii) determining an associated lane center variable having an associated lane center range value closest to the vehicle; iii) estimating a vehicle displacement from the associated lane center range value, and iv) calculating a new lane center range value for the associated lane centre variable using the associated lane center range value and the vehicle displacement.

20 Claims, 7 Drawing Sheets

OTHER PUBLICATIONS

Kim I.S., Jeong K., Kwon Jeong J.: "Two Novel Radar Vehicle Detectors for the Replacement of a Conventional Loop Detector"—Microwave Journal, vol. 44, No. 7, Jul. 2001, pp. 22, 26-28, 32, 35, 38, 40.
Krämer G.: "Envisioning a Radar-Based Automatic Road Transportation System"—Intelligent Transportation Systems, May/Jun. 2001, pp. 75-77.
Dailey D.J.: "A Statistical Algorithm for Estimating Speed from Single Loop Volume and Occupancy Measurements", Transportation Research Board, Part B33 (1999), pp. 133-136.
Stewart B.D., Reading I., Thomson, M.S., Binnie T.D., Dickinson K.W., Wan C.L.: "Adaptive Lane Finding In Road Traffic Image Analysis"—Road Traffic Monitoring and Control, Apr. 26-28, 1994, Conference Publication No. 391, IEE, 1994.
Smith R.L., Arnold D.V.; "Development of a Low Cost, FM/CW Transmitter for Remote Sensing"—Vehicle Detector Workshop TexITE Jun. 2000.
Unknown; "Loren Multi-Lane Microwave Detector"—Electronique Controle Mesure, Date Unknown.
Unknown; "RTMS Radar Traffic Detection—General Information", EIS Integrated Sysems Inc., Jul. 21, 2001, pp. 1-6.
Lion D.; "Radar for Automatic Incident Detection and Traffic Analysis: The Beatrics Sensors"—Proceedings of the First World Congress on Applications of Transport Telematics and Intelligent Vehicle-Highway Systems 1995 ERTICO, pp. 1285-1290.
Ma B., Lakshmanan S., Hero A.; "Road and Lane Edge Detection with Multisensor Fusion Methods"—0-7803-5467-2/99 1999 IEEE.
Gern A., Franke U.; "Advanced Lane Recognition—Fusing Vision and Radar"—Proceedings of the IEEE Intelligent Vehicles Symposium 2000, Oct. 3-5, 2000, pp. 45-51.
Gonzalez J.P., Ozguner, U.; "Lane Detection Using Histogram-Based Segmentation and Decision Trees"—2000 IEEE Intelligent Transportation System Conference Proceedings, Oct. 1-3, 2000, pp. 346-351.
Frederick J.D., Qian Y. and ITOH, T; "A Novel Single Card FMCW Radar Transceiver with On Board Monopulse Processing"—No date.
Unknown; "Accuwave LX-150 Microwave Detector"—No date.
Unknown; "Task Force L Final Report"—Executive Summary, pp. 1-40, Jan. 16, 2002.
Unknown; "Sensors"—Transportation Operations Group, Vehicle Detection Workshop, Tex/TE Jun. 2000, pp. 1 of 13, 2 of 13, 11, 12.
Unknown; "RTMS Traffic Detector Primer"—EIS Electronic Integrated Systems Inc. Jul. 21, 2001, pp. 1-4.
Unknown; "Automatic Lane Detection"—No Date.
Beard J.C. and Arnold D.V.; "6GHz Range Finder Using Pulse Compression"—IGARSS 2000.
Derneryd A.G.; "Linearly Polarized Microstrip Antennas"—IEEE Transactions on Antennas and Propagation, Nov. 1976, pp. 846-851.
Kranig J., Minge, E. Jones C.; "Field Test of Monitoring of Urban Vehicle Operations Using Non-Intrusive Technologies"—Final Report—FHWA-PL-97-018, Part IV—Department of Transportation Federal Highway Administration, May 1997.
Middleton D. and Parker R.; "Initial Evaluation of Selected Detectors to Replace Inductive Loops on Freeways"—Report 1439-7—Apr. 2000.
Unknown; "Detection Technology: for IVHS—vol. 1: Final Report Addendum" Publication Number: FHWA-RD-96-100, Publication Date: Jul. 1995 (§ 12).
SmarTek Acoustic Sensor—Version 1 (SAS-1)—Installation and Setup Guide, Jul. 25, 2005.
Unknown: "On-Bench Photographs of Detectors"—pp. 1-9, Jan. 16, 2002.
RTMS User Manual Issue 3.2 by EIS, describing the automatic set up and lane configuration pp. 9-13—Publication date Apr. 2004.
SmarTek Acoustic Sensor Version 1 Installation and Setup Guide Jul. 25, 2000.
A Photo Showing the RTMS model XX3 from inside—Release date Sep. 2003.
RTMS User Manual Issue 3.2 by EIS, describing the configuration of a traffic sensor currently in production by EIS—RTMS model X3—Publication dated Apr. 2004.

* cited by examiner

METHOD AND APPARATUS FOR PROVIDING AUTOMATIC LANE CALIBRATION IN A TRAFFIC SENSOR

FIELD OF THE INVENTION

The present invention relates in general to traffic sensors, and more particularly relates to the calibration of traffic sensors based on a range or distance of vehicles measured from the traffic sensor.

BACKGROUND OF THE INVENTION

As urban centers increase in size, and traffic congestion becomes increasingly a problem, there is a concomitant increasing need for current and accurate traffic statistics and information. Traffic surveillance relies primarily upon traffic sensors, such as (1) inductive loop traffic sensors, which are installed under the pavement; (2) video sensors; (3) acoustic sensors; and, (4) radar sensors. Inductive loop sensors, which are installed under the pavement, are expensive to install, replace and repair, both in terms of roadwork required and in terms of the disruption to traffic. In contrast, video sensors, acoustic sensors and radar sensors are easier to install, replace and repair. They have the added advantage of multi-lane detection by a single sensor. On the other hand, their accuracy depends on centering their detection zones on traffic lanes.

Video sensors typically detect vehicles based on recognizable automobile characteristics. Acoustic sensors rely on sound waves to build up a picture of traffic conditions. Radar sensors typically transmit low-power microwave signals at the traffic, and detect vehicles based on the reflected signals. However, all of these sensors require initial detection zones or lanes to be defined in order to operate accurately.

This calibration of detection zones or lanes in sensors may be provided by a technician. However, this is expensive both in terms of paying the technician, and due to the resulting disruption of traffic. Alternatively, detection zones may be defined automatically and automatically centered on traffic lanes.

SUMMARY OF THE INVENTION

In accordance with an aspect of the invention there is provided a method of operating a traffic sensor to define ranges of centers of traffic lanes from the traffic sensor. The method comprises a) providing a set of lane center variables representing the ranges of the centers of the traffic lanes from the traffic sensor; b) initializing each lane center variable in the set of lane center variables to have an associated starting range value; and then, c) updating the set of lane center variables, for each vehicle in a plurality of vehicles, by i) detecting the vehicle, ii) determining an associated lane center variable having an associated lane center range value closest to the vehicle; iii) estimating a vehicle displacement from the associated lane center range value, and iv) calculating a new lane center range value for the associated lane centre variable using the associated lane center range value and the vehicle displacement.

A sensor for obtaining vehicular traffic data, the sensor comprising: at least one antenna for transmitting radiation to a vehicle and for receiving the radiation reflected back from the vehicle; a transceiver circuit for electrically driving the antenna; a processor unit for driving and processing electrical signals from the transceiver circuit to obtain vehicular traffic data. The processor unit is operable to define ranges of centers of traffic lanes by performing the steps of a) providing a set of lane center variables representing the ranges of the centers of the traffic lanes from the traffic sensor; b) initializing each lane center variable in the set of lane center variables to have an associated starting range value; and then, c) updating the set of lane center variables by, for each vehicle in a plurality of vehicles, i) detecting the vehicle, ii) determining an associated lane center variable having an associated lane center range value closest to the vehicle, iii) estimating a vehicle displacement from the associated lane center range value, and iv) calculating a new lane center range value for the associated lane centre variable using the associated lane center range value and the vehicle displacement.

BRIEF DESCRIPTION OF THE DRAWINGS

A detailed description of preferred aspects of the invention is provided herein below with reference to the following drawings in which.

DETAILED DESCRIPTION OF PREFERRED ASPECTS OF THE INVENTION

Figure 1:
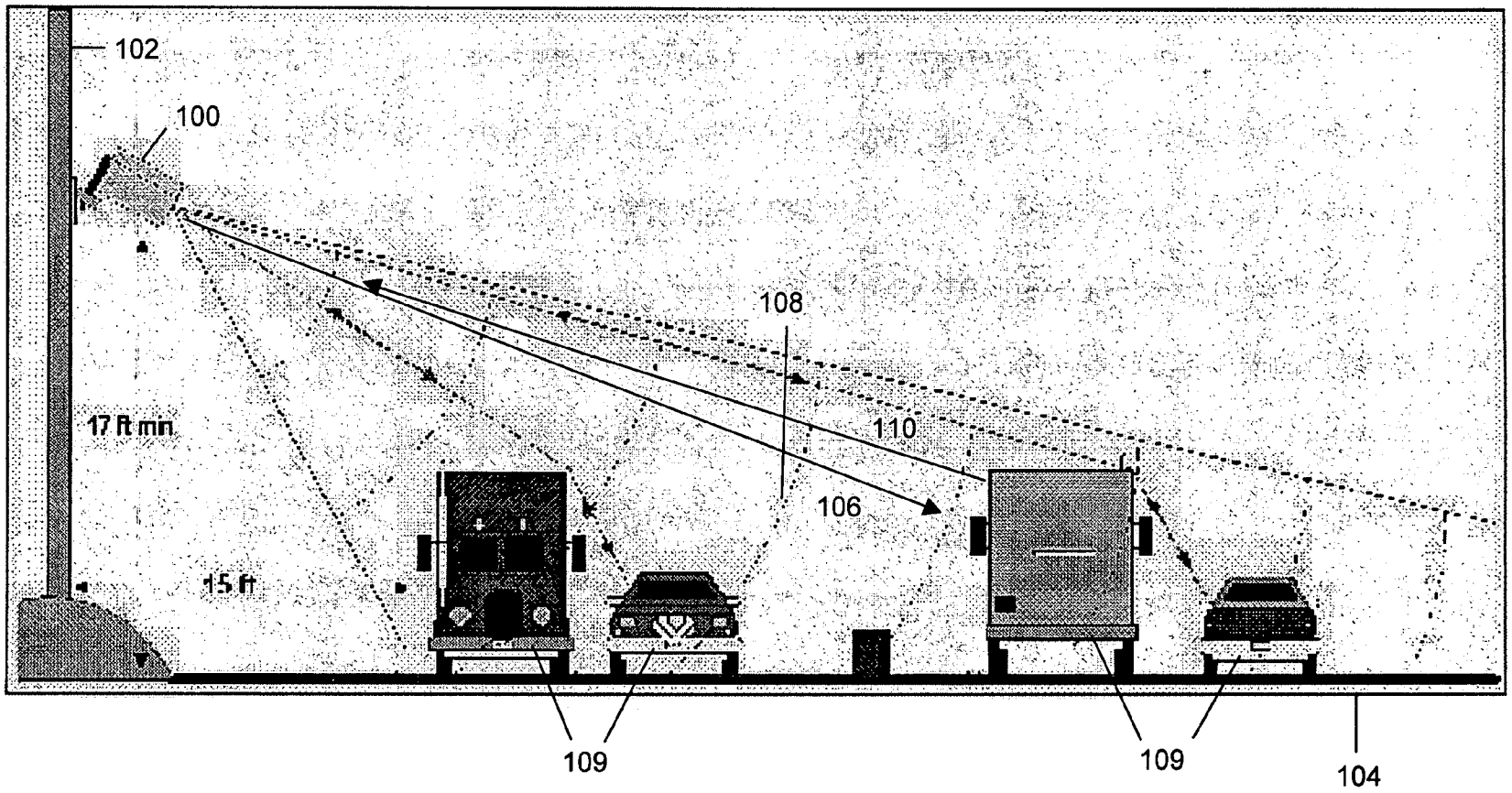
FIG. 1, in a schematic view, illustrates a traffic monitoring system in accordance with an aspect of the present invention.

Referring to FIG. 1, there is illustrated in a schematic view, a sensor 100 in accordance with a preferred aspect of the present invention. The sensor 100 is mounted on a pole 102 in a side-mounted configuration relative to road 104. Sensor 100 transmits a signal 106 through a field of view 108 at the road 104 to "paint" a long elliptical footprint on the road 104. Any non-background targets, such as vehicles 109, reflect a reflected signal Pr 110 having power level P. Specifically, the low-power microwave signal 106 transmitted by sensor 100 has a constantly varying frequency. Based on the frequency of the reflected signal 110, the sensor can determine when the original signal was transmitted, thereby determining the time elapsed and the range to the reflecting object. The range of this reflected object is the "r" in Pr.

Figure 2:
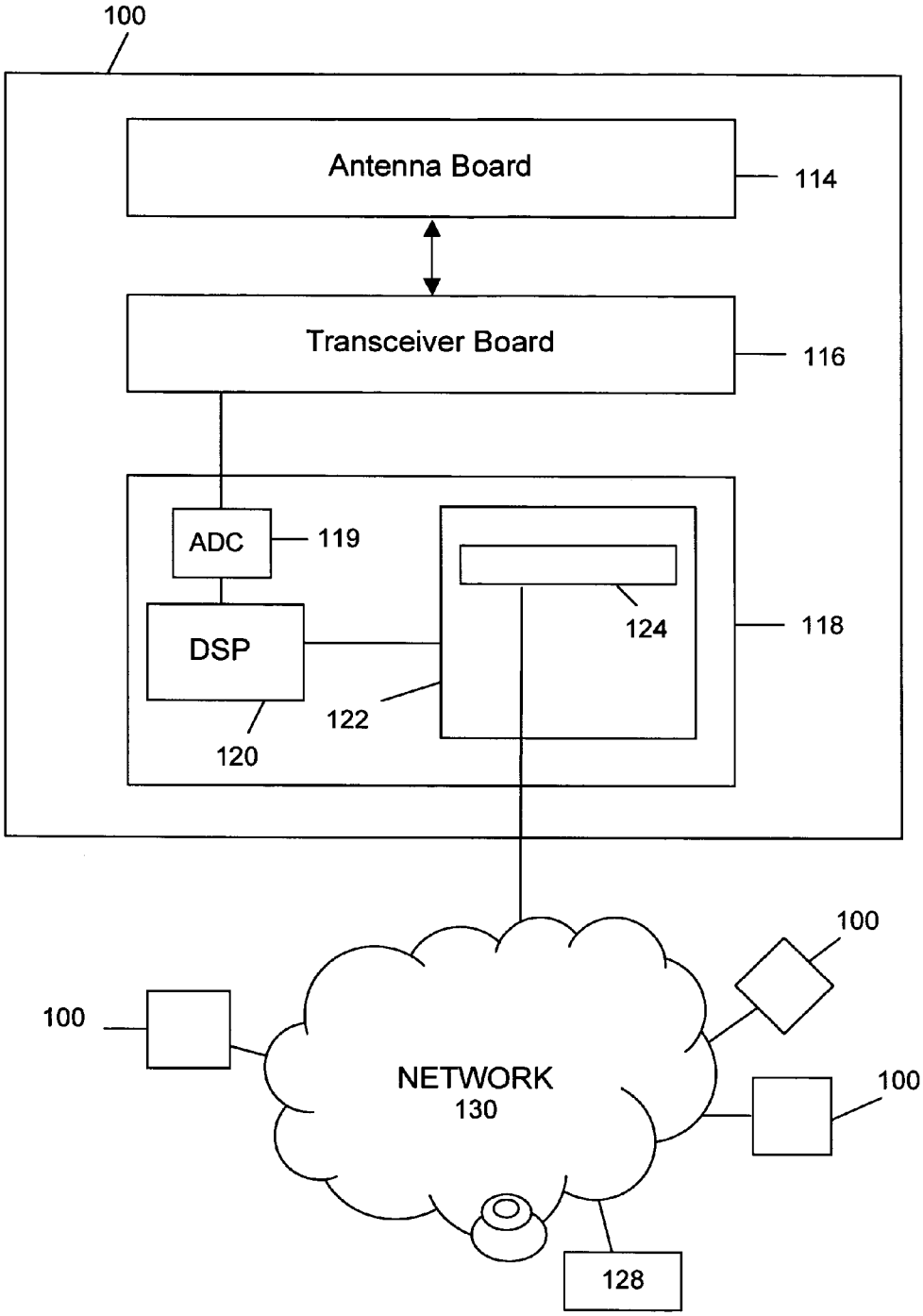
FIG. 2, in a block diagram, illustrates the traffic sensor of FIG. 1; and, FIG. 3, in a flowchart, illustrates a method of defining ranges of the centers of traffic lanes from a traffic sensor in accordance with an aspect of the invention.

Referring to FIG. 2, the components of the sensor 100 are illustrated in a block diagram. As shown, the sensor 100 comprises an antenna board 114 for transmitting the signal 106 through field of view 108, and for receiving the reflected signal 110 back from the roadway. A transceiver board 116 is in electronic communication with, and drives, antenna board 114. Transceiver board 116 also receives the reflected signals from the antenna board 114, and transmits this information to a processor module 118. Preferably, processor module 118 comprises an Analog to Digital Converter (ADC) 119, a digital signal processor (DSP) chip 120 and a separate microcomputer chip 122. This microcomputer chip 122 in turn comprises an internal, non-volatile memory 124. In operation, the ADC 119 digitizes the reflected signal at specific sample times, the DSP chip 120, which is a high-speed chip, does the raw signal processing of the digitized electrical signals received from the transceiver board 116. That is, the DSP chip 120 preferably determines if a vehicle is present by determining if the stream of electrical signals received from the transceiver board 116 meets a vehicle detection criteria. The DSP chip 120 also preferably determines the range of the vehicle from the sensor. This vehicle detection information is then sent to the microcomputer chip 122, which configures this data for transmission to external traffic management system 128 via network 130. Microcomputer chip 122 may also collate aggregate traffic density information from this information, Optionally, the processor module 118 includes but a single DSP processor, which single DSP processor will, of necessity, have to handle the interface with external traffic management system 128 via network 130 in addition to the other tasks performed by DSP chip 120. Typically, sensor 100 will be just one of many sensors as illustrated in FIG. 2, which are connected to external traffic management system 128 via network 130.

In addition to the detection of vehicles described above, the sensor 100 automatically detects traffic activity and sets zones to be centered on the ranges of this activity. This enables the sensor 100 to detect and correct for deviation from previously defined zone centers and current traffic. This deviation may, for example, result from temperature drift.

The reflected signals Pr are generated in real-time such as, for example without limitation, every 1 mS. As described above, each reflected signal Pr has power level <P> and range <r>. Specifically, the elliptical footprint projected onto the road 104 by signal 106 is divided up into uslice ranges <r> each of which uslices is at a different distance from the sensor. The thickness of these uslices is selected such that several uslices are required to span the width of a single lane. For example without limitation, each uslice range can be about 40 cm thick, although this may change depending on the resolution of the sensor 100.

To first detect the vehicles and then determine lane centers, the processor module 118 maintains the following data structures:

Zi is the range (in uslices) of tentative zone number i

ΣΔi is the sum of errors of zone Zi

Ai is the sum of activities of zone Zi

Ti is a time-out counter, which is incremented by one every 1 mS.

Fi is a Boolean flag indicating, when Fi=1, that zone Zi is on an active lane.

In the above data structure, i represents the particular zone center of a data structure. For example, without limitation, i may be any integer in the range of 1 to 16 inclusive, 16 being the maximum number of zone centers. Alternatively, some other maximum number of zone centers may be used.

Ai represents the sum of activities, which is defined for a particular vehicle, instead of being defined for a plurality of vehicles. That is, Ai is incremented for every reflected signal Pr received during a vehicle's passage through the footprint provided that the reflected signal Pr is received within the range r=Zi preceding, for example without limitation, a 100 mS gap interval during which no reflected signal Pr is received from that lane. A time-out counter Ti is also provided. The 100 mS interval is measured by time-out counter Ti, which is incremented by 1 every 1 mS. Of course, time-out intervals other than 100 mS may be used.

Initially, no uslices are designated as preliminary zones centers: thus, Zi=0; Fi=0; ΣΔi=0; and, Ai=0 for i=1 to 16. For a suitable time interval, such as 1 minute or so, data is collected in the 32 counters associated with zone centers that are dynamically defined. That is, for every reflected signal sample Pr, the processor module 118 checks whether there is a previously defined zone center Zi where ABS(Zi−r)<some selected maximum distance, such as, for example without limitation, 7 uslices. If there is no previously defined zone center that satisfies this inequality, than a new tentative zone center is defined as Zi=r. The corresponding activity counter Ai for this zone center Zi is then set; Ai=1. Similarly its timer Ti is set; Ti=0.

On the other hand, if there is at least one previously defined zone center Zi that is sufficiently close to the uslice range r such that the ABS(Zi−r)<7, then this nearest zone center Zn is associated with Pr.

In cases where a previously defined zone center is associated with Pr, then the range deviation, r−Zn, for this signal is added to the sum of errors for that zone center, and An and Tn adjusted, as follows:

$$\Sigma\Delta n=\Sigma\Delta n+(r-Zn);An=An+1;\ Tn=0$$

By this means, Ai counts the number of valid signals associated with zone centers Zi, while ΣΔi (represented as ΣΔn in the above equation) represents the sum of the signed errors (deviations of the signal uslice from Zi). Ti, which is the time counter, will typically have low counts during a burst arising from a passing vehicle, as Ti will be reset to zero each time a reflected signal Pr is received close to Zi. The Ti counter for each zone center Zi is checked against a fixed time-out KT=100 periodically; preferably, every one millisecond. For example without limitation, KT may be set equal to 100. If Ti>KT, indicating that there has been no activity in Zi for KT milliseconds, then, if Ai<some selected minimum activity level KA, Ai, ΣΔi and Ti are all set equal to zero. For example without limitation, KA can equal 100. In other words, if there has not been enough activity near to a zone center before there is a gap of KT (in this case 100 mS) in which no further reflected signals are received, then whatever reflected signals Pr have been received are assumed to not have resulted from vehicles, but from some other temporary obstruction that reflected the signal 106. On the other hand, if, when Ti is greater than KT, Ai is greater than KA, than a vehicle is assumed to have passed, and Zi is corrected or updated according to the formula Zi=Zi+(ΣΔi/Ai). In other words, the average error in the ΣΔ i is used to shift the zone centers to where activity is centered. Subsequently, the Boolean counter Fi is set equal to 1, Ai is set equal to zero, ΣΔi is set equal to zero and Ti is set equal to zero. At the end of the collection period, only those zones that have been center-corrected based on a significant burst of activity (at least one vehicle), in which there have been no long time-out gaps—long, in this case, being time-out gaps greater than 100 mS—will have a positive Fi indicating that they are on active traffic lanes.

Figure 3:
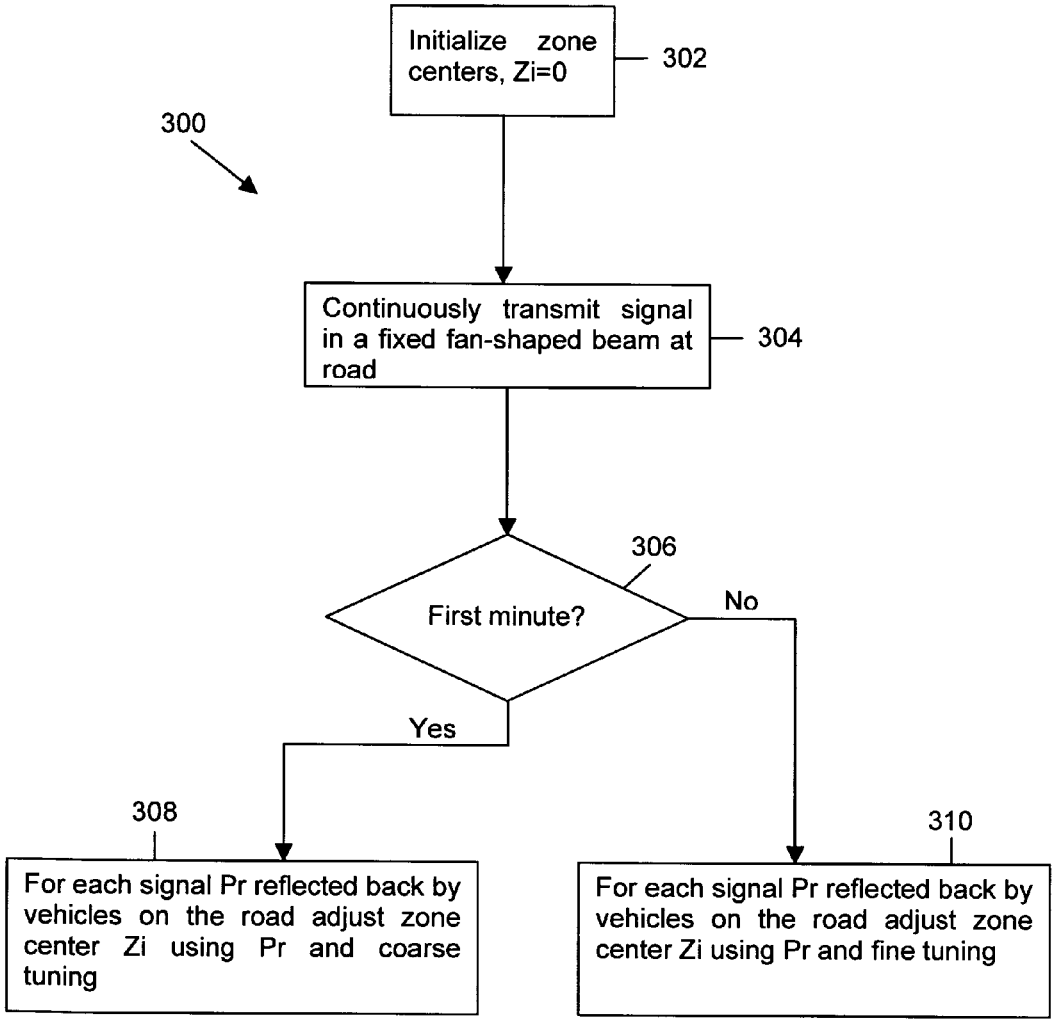

Referring to FIG. 3, there is illustrated in a flowchart, a method of defining the ranges of centers of traffic lanes from the traffic sensor 100 in accordance with an aspect of the invention. The sensor 100 is configured to provide a set of lane center variables representing the ranges of the centers of traffic lanes from the traffic sensor. These are the zone centers Zi described above. In step 302 of the flowchart 300 of FIG. 3, each of the zone centers Zi is initialized by being assigned a starting range value—in this case 0. In step 304, the sensor 100 transmits a signal in a fixed fan-shaped beam at the road, as shown in FIG. 1. The steps performed based on the reflected signals Pr will depend on when these reflected signals are received. That is, during the first minute, the method 300 proceeds, via query 306, to step 308 in which each of the signals Pr reflected back from a vehicle on the road is used to locate new zone centers and to adjust the nearest zone center Zi using coarse tuning. If, on the other hand, this initial coarse-tuning period of one minute has already elapsed, then the method 300 will proceed, via query 306, to step 310 in which each of the reflected signals Pr is used to make fine-tuning adjustments to the zone center Zi. Steps 308 and 310 are described in more detail in relation to FIGS. 4*a* and 4*b*, and FIGS. 5*a* and 5*b* respectively. Concurrent with steps 308 and 310, step 304, in which a fixed fan-shaped beam is continuously transmitted at the road, continues.

Figure 4A:
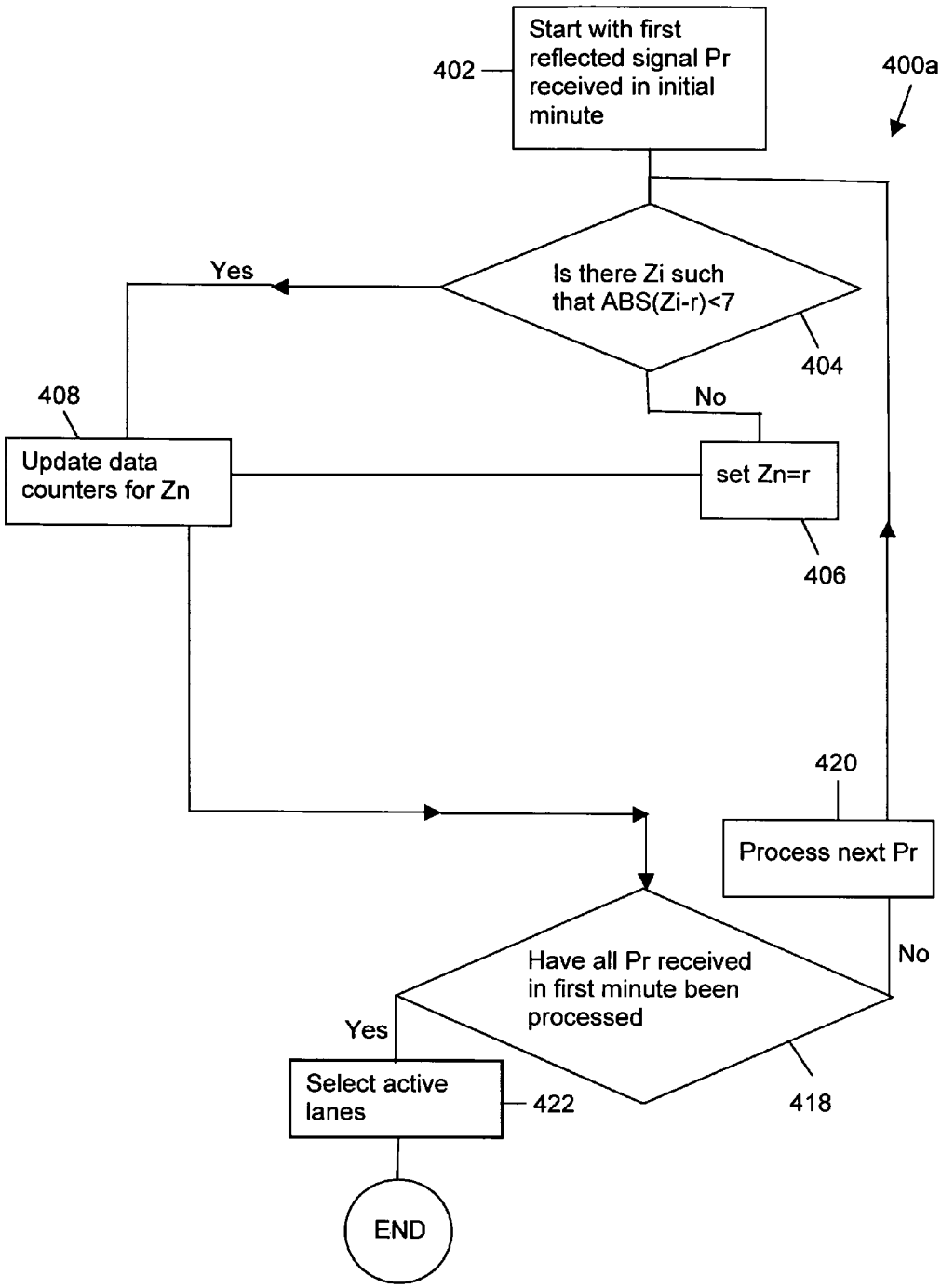
FIG. 4*a*, in a flowchart, illustrates coarse tuning steps of the method of FIG. 3.

Referring to FIG. 4*a*, there is illustrated in a flowchart a method 400*a* for detecting and adjusting zone centers Zi based on reflected signals Pr received and coarse tuning. The method 400*a* begins with the first reflected signal Pr received in the initial minute in step 402. The method 400*a* then proceeds to query 404 in which the processor checks whether there is a previously defined zone center Zi such that ABS (Zi−r)<7. In this formula, "7" designates 7 uslices. Accordingly, this initial selection threshold checks whether there is a previously defined zone center Zi within 2.8 m of r.

If there is no Zi such that ABS(Zi−r)<7, then query 404 returns the answer NO, and method 400*a* proceeds to step 406, in which one of the unused zone centers, Zn, is set equal to r. The method then proceeds to step 408. If query 404 returns the answer YES, in that there is a zone center Zn within 2.8 m of r, then method 400*a* proceeds directly to step 408 from query 404.

In step 408, the data counters for Zn are updated. That is, in the case where a new Zn was set equal to r in step 406, and the method 400*a* then proceeded to step 408, the An for this new Zn is set equal to 1 and its time-out counter Tn is set equal to zero. Alternatively, if the method 400*a* proceeded directly to step 408 from query 404, An is increased by 1, and Tn is again set equal to zero. Specifically, the An for this Zn is incremented by one, and Tn is set equal to zero. In addition, ΣΔi is adjusted by adding (r−Zn).

After step 408, the method 400*a* proceeds to query 418, which checks whether all of the reflected signals for the first minute have been processed. If the reflected signals in this first minute have not yet been processed, then the method proceeds to step 420 in which the next reflected signal Pr is processed, before returning to query 404. If, on the other hand, query 418 returns the answer YES, as all of the reflected signals received in the first minute have been processed, then in step 422, method 400*a* selects those zone centers Zi for which the Boolean counter Fi is positive (described in connection with step 416 of FIG. 4*b*), the remaining zone centers being dropped. The method then terminates. Subsequently, in the fine-tuning step 310 of the method of FIG. 3, which is illustrated in more detail in FIG. 5*a*, the precise location of each of these active lanes selected in step 422 will be fine-tuned.

Figure 4B:
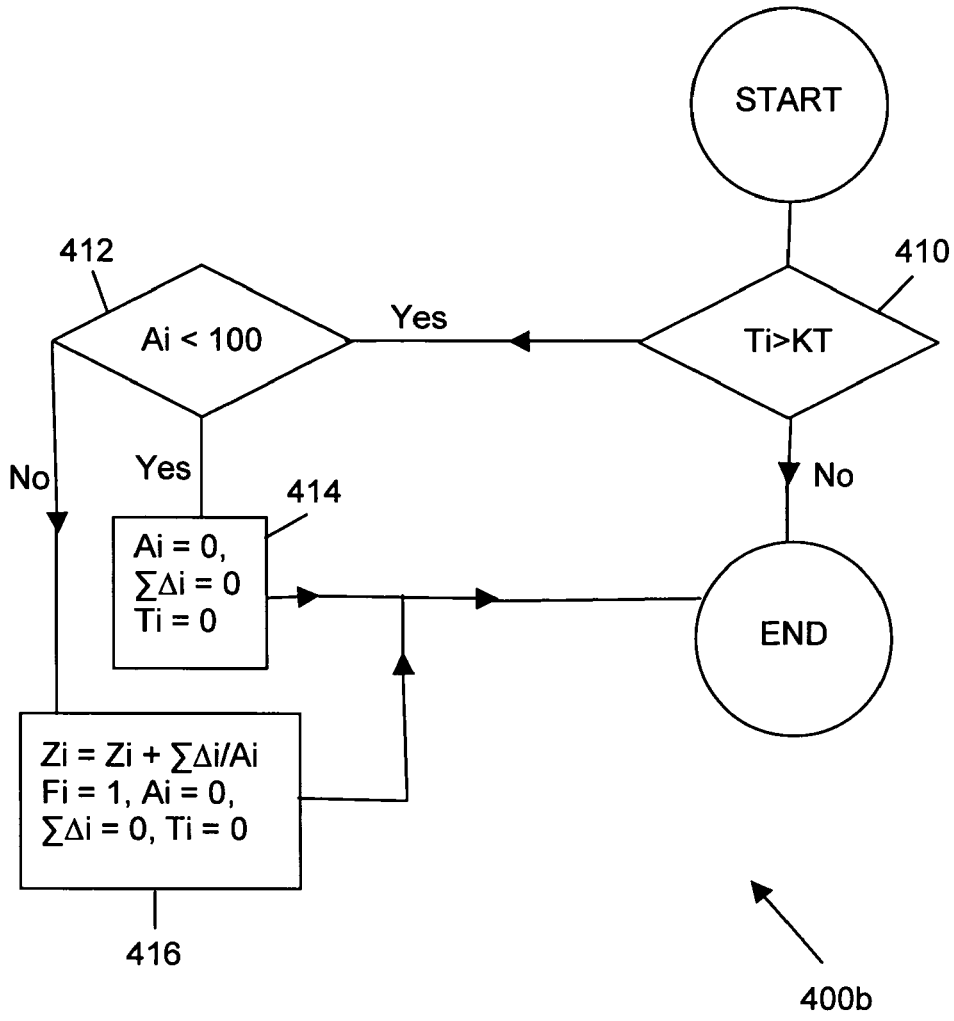
FIG. 4*b*, in a flowchart, illustrates a coarse tuning loop executed contemporaneously with the method of FIG. 4*a;*

While method 400*a* is executing as described above in connection with FIG. 4*a*, a loop in which the data counters for each Zi is updated every 1 mS is executed as illustrated in FIG. 4*b*. Specifically, the method of loop 400*b* of FIG. 4*b* begins with query 410 in which the time-out counter Ti, for each zone center Zi (and not just the particular Zn considered in steps 406 and 408), is checked against a fixed time-out amount KT—in this case, 100 mS. If, in the case of a particular Ti, this Ti is not greater than 100 mS, then query 410 returns the answer NO, and the data counters for this zone center Zi are not further considered on this iteration of the method 400*b*. If, on the other hand, query 410 returns the answer YES, in that Ti is greater than 100 mS, then method 400*b* proceeds to query 412, which checks whether there has been sufficient activity around this zone center. Specifically, query 412 checks whether the sum of activities is less than the selected minimum activity level KA—in this case 100. If the sum of activities is less than 100, then this indicates that there has been insufficient activity, and method 400*b* proceeds to step 414 in which the sum of activities Ai, the sum of errors ΣΔi, and the time-out counter Ti are all set equal to zero. Queries 410 and 412 are inserted into method 400*b* to provide a filter to filter out temporary obstructions that may result in reflected signals Pr, but which temporary obstructions are not vehicles. That is, vehicles are sufficiently large such that they will typically provide sufficient activity prior to a 100 mS gap, while aberrant reflected signals will typically not be repeated for long enough to provide sufficient activity and will thus be filtered out by query 412, and step 414.

If there has been sufficient activity, in that the sum of activities Ai is not less than 100, then method 400*b* proceeds to step 416 from query 412. In step 416, zone center Zi is updated by adding the average deviation error, according to the formula Zi=Zi+(ΣΔi/Ai). The Boolean counter Fi is also set equal to 1. Finally, as is the case in step 414, Ai, ΣΔi, and Ti are all set equal to zero.

Figure 5A:
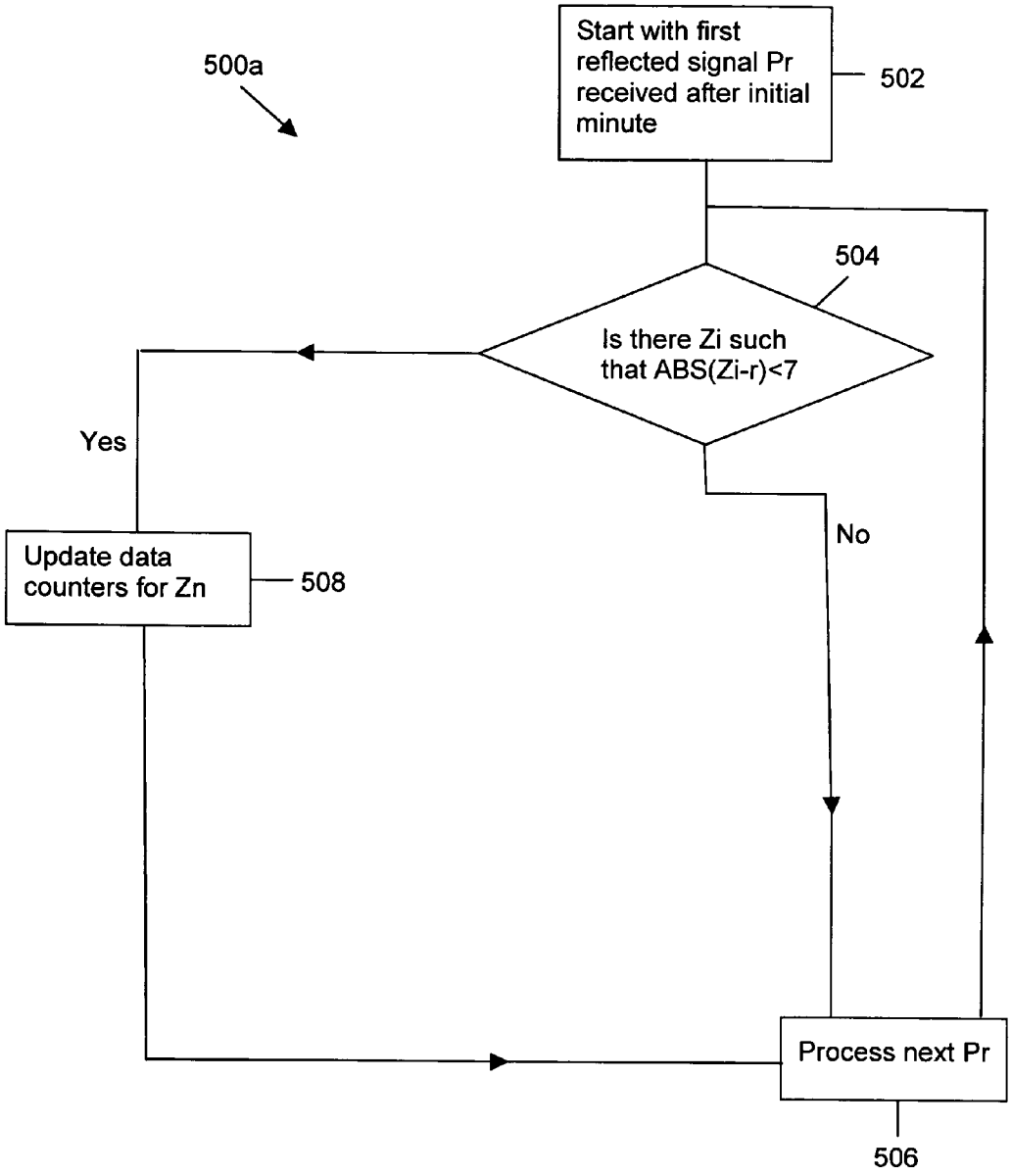
FIG. 5*a*, in a flowchart, illustrates fine-tuning steps of the method of FIG. 3; and, FIG. 5*b*, in a flowchart, illustrates a fine-tuning loop executed contemporaneously with the method of FIG. 5*a*.

Referring to FIG. 5*a*, there is illustrated in a flowchart a method 500*a* for adjusting zone centers Zi based on reflected signals Pr received after the first minute and fine-tuning. The zone centers Zi adjusted by method 500*a* are those zone centers in which the Boolean Fi was set equal to 1 in method 400*b*. The method 500*a* begins with the first reflected signal Pr received after the initial minute in step 502. The method 500*a* then proceeds to query 504 in which the processor checks whether there is a previously defined zone center Zi such that ABS(Zi−r)<7. As in the case of coarse tuning, this initial selection threshold checks whether there is a previously defined zone center Zi within 2.8 m of r. However, as all of the active lanes (lanes for which Fi=1) have already been determined during coarse tuning, if there is no Zi such that ABS(Zi−r)<7, then this reflected signal is simply dropped, and the method proceeds to step 506 in which the next reflected signal Pr is processed. In other words, during fine-tuning any signal that is too far removed from the center of any active lane will simply be dropped and ignored all-together.

If, on the other hand, query 504 returns the answer YES, in that there is a zone center within 2.8 m of r, then the method 500*a* proceeds to step 508.

In step 508, the data counters for the Zn satisfying the selection criteria of query 504 are updated. Specifically, the An for this Zn is incremented by one, and Tn is set equal to zero. In addition, ΣΔi is adjusted by adding (r−Zn). After step 508, method 500*a* proceeds to step 506.

Figure 5B:
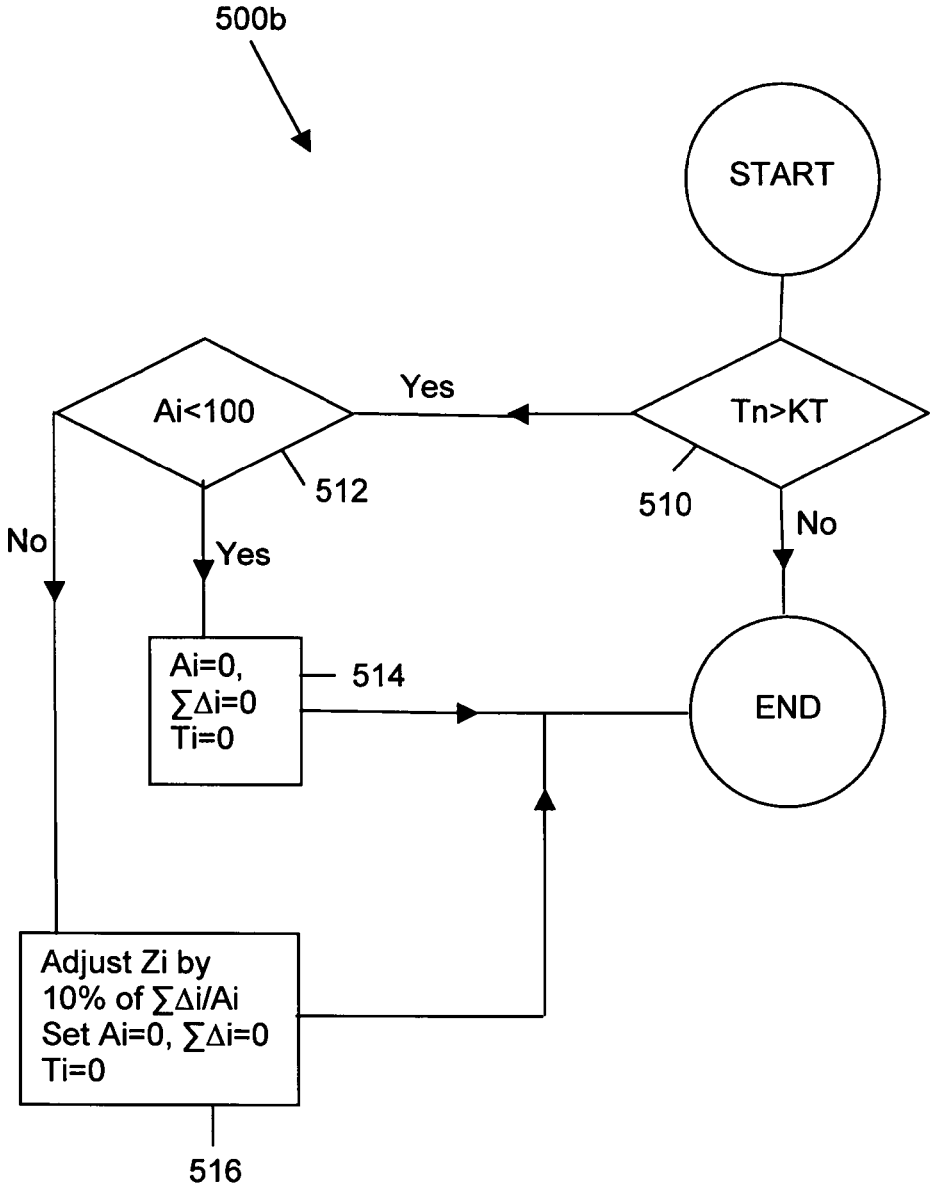

While method 500*a* is executing, a fine-tuning loop or method 500*b*, as illustrated in FIG. 5*b* is executed at the same time. This method 500*b* is executed for each active lane Zi (different from the Zi in coarse tuning, as inactive lanes have been dropped), each 1 mS. The method 500*b* begins with query 510 in which the time-out counter Ti, for each zone center Zi, is checked against the fixed time-out counter KT (100 mS in this case). If, in the case of a particular Ti, this Ti is not greater than 100 mS, then query 510 returns the answer NO, and the loop is finished executing for that 1 mS. Accordingly, the data counters for this zone center Zi are not further considered on this iteration of the method 500*b*. If, on the other hand, query 510 returns the answer YES, in that Ti is greater than 100 mS, then method 500*b* proceeds to query 512, which checks whether there has been sufficient activity around this zone center. Specifically, query 512 checks whether the sum of activities is less than 100. If the sum of activities is less than 100, then this indicates that there has been insufficient activity, and method 500*b* proceeds to step 514 in which the sum of activities Ai, the sum of errors $\Sigma\Delta i$, and the time-out counter Ti are all set equal to zero. As with coarse tuning, queries 510 and 512 are inserted into the fine-tuning loop 500*b* to provide a filter to filter out temporary obstructions that may result in reflected signals Pr, but which temporary obstructions are not vehicles.

If there has been sufficient activity, in that the sum of activities Ai is not less than 100, then the method 500*b* proceeds to step 516 from query 512. In step 516, zone center Zi is updated by adding 10% of the average deflection error, according to the formula $Zi,=Zi+0.1\times(\Sigma\Delta i/Ai)$. In addition, Ai, $\Sigma\Delta i$ and Ti are all set equal to zero.

Other variations and modifications of the invention are possible. For example, during fine-tuning, instead of the zone center Zi being updated by adding 10% of the average deflection error, this zone center Zi could be updated by adding a different percentage of this deflection error. Whatever percentage is selected should, of course, be less than the percentage of the average deviation error used to update the zone center Zi during coarse tuning. For example, the selected percentage of the average deflection error used to update the zone center Zi might be greater than 50% in the case of coarse tuning, and less than 50% in the case of fine-tuning. More preferably, this selected percentage might be greater than 75% in the case of coarse tuning and less than 25% in the case of fine-tuning. Optionally, between the coarse and fine-tuning phases, zones may also be displayed to a technician to let him edit the preliminary zone settings—for example, delete a zone due to an accidental passage of one vehicle. All such modifications or variations are believed to be within the sphere and scope of the invention as defined by the claims appended hereto.

The invention claimed is:

1. A method of operating a traffic sensor to define ranges of centers of traffic lanes from the traffic sensor, the method comprising:

a) providing a set of lane center variables representing the ranges of the centers of the traffic lanes from the traffic sensor;

b) initializing each lane center variable in the set of lane center variables to have an associated starting range value; and then, c) updating the set of lane center variables by, for each vehicle in a plurality of vehicles, i) detecting the vehicle, ii) determining an associated lane center variable having an associated lane center range value closest to the vehicle, iii) estimating a vehicle displacement from the associated lane center range value, and iv) calculating a new lane center range value for the associated lane centre variable using the associated lane center range value and the vehicle displacement.

2. The method as defined in claim 1 wherein step c) iv) comprises determining the new lane center range value to be a selected percentage of the vehicle displacement from the associated lane center range value.

3. The method as defined in claim 2 further comprising a coarse tuning phase and a fine tuning phase following the coarse tuning phase, wherein the selected percentage is reduced from the coarse tuning phase to the fine tuning phase.

4. The method as defined in claim 3 wherein step c) iii) further comprises flagging the associated lane center variable, the method further comprising, at an end of the coarse tuning phase, removing each associated lane center range value that has not been flagged from the set of lane center variables for the fine tuning phase.

5. The method as defined in claim 4 wherein the course tuning phase ends after one of a selected number of vehicles have been detected, and a selected time interval has passed.

6. The method as defined in claim 3 wherein during the coarse tuning phase the selected percentage is greater than 50%, and during the fine tuning phase the selected percentage is less than 50%.

7. The method as defined in claim 3 wherein during the coarse tuning phase the selected percentage is greater than 75%, and during the fine tuning phase the selected percentage is less than 25%.

8. The method as defined in claim 2 wherein the selected percentage is less than 50%.

9. The method as defined in claim 3 wherein step c) i) comprises transmitting a stream of signals at the vehicle to generate a stream of reflected signals back from the vehicle;

receiving the stream of reflected signals back from the vehicle, wherein each reflected signal in the stream of reflected signals indicates a corresponding range location; and, determining that a length of the stream of reflected signals exceeds a selected vehicle detection threshold.

10. The method as defined in claim 9 further comprising determining that the stream of reflected signals has ended when no additional reflected signals are detected for a selected time interval.

11. The method as defined in claim 9 wherein step c) further comprises, processing each signal in the stream of reflected signals by, determining a corresponding differential distance between the corresponding range location and the associated lane center range value closest to the corresponding range location;

during the coarse tuning phase, if the corresponding differential distance is greater than a selected threshold distance from the corresponding range location, then re-determining the associated lane center range value to be the corresponding range location, otherwise adding the corresponding distance differential to an aggregate distance differential; and during the fine tuning phase, if the corresponding differential distance is greater than the selected threshold distance from the corresponding range location, then discarding the corresponding range location without adjusting the aggregate distance differential, otherwise adding the corresponding differential distance to the aggregate distance differential; and, after processing each signal in the stream of reflected signals, determining the vehicle displacement to be an average distance differential in the aggregate distance differential.

12. A sensor for obtaining vehicular traffic data, the sensor comprising:

at least one antenna for transmitting radiation to a vehicle and for receiving the radiation reflected back from the vehicle;

a transceiver circuit for electrically driving the antenna;

a processor unit for driving and processing electrical signals from the transceiver circuit plate to obtain vehicular traffic data, wherein the processor unit is operable to define ranges of centers of traffic lanes by performing the steps of a) providing a set of lane center variables representing the ranges of the centers of the traffic lanes from the traffic sensor;

b) initializing each lane center variable in the set of lane center variables to have an associated starting range value; and then, c) updating the set of lane center variables by, for each vehicle in a plurality of vehicles, i) detecting the vehicle, ii) determining an associated lane center variable having an associated lane center range value closest to the vehicle, iii) estimating a vehicle displacement from the associated lane center range value, and iv) calculating a new lane center range value for the associated lane centre variable using the associated lane center range value and the vehicle displacement.

13. The traffic sensor as defined in claim 12 wherein step c) iv) comprises determining the new lane center range value to be a selected percentage of the vehicle displacement from the associated lane center range value.

14. The traffic sensor as defined in claim 13 wherein the processor unit has a coarse tuning phase and a fine tuning phase following the coarse tuning phase for defining ranges of centers of traffic lanes, wherein the selected percentage is reduced from the coarse tuning phase to the fine tuning phase.

15. The traffic sensor as defined in claim 14 wherein step c) iii) further comprises flagging the associated lane center variable, and the processor unit is further operable, at an end of the coarse tuning phase, to remove each associated lane center range value that has not been flagged from the set of lane center variables for the fine tuning phase.

16. The traffic sensor as defined in claim 15 wherein the course tuning phase ends after one of a selected number of vehicles have been detected, and a selected time interval has passed.

17. The traffic sensor as defined in claim 14 wherein during the coarse tuning phase the selected percentage is greater than 50%, and during the fine tuning phase the selected percentage is less than 50%.

18. The traffic sensor as defined in claim 14 wherein during the coarse tuning phase the selected percentage is greater than 75%, and during the fine tuning phase the selected percentage is less than 25%.

19. The traffic sensor as defined in claim 14 wherein the at least one antenna is operable to transmit a stream of signals at the vehicle to generate a stream of reflected signals back from the vehicle, and to receive the stream of reflected signals back from the vehicle, wherein each reflected signal in the stream of reflected signals indicates a corresponding range location; and, step c)i) comprises determining when a length of the stream of reflected signals exceeds a selected vehicle detection threshold.

20. The traffic sensor as defined in claim 19 wherein step c)i) further comprises determining that the stream of reflected signals has ended when no additional reflected signals are detected for a selected time interval.

* * * * *